US005467845A

United States Patent [19]

Scruggs

[11] Patent Number: 5,467,845

[45] Date of Patent: Nov. 21, 1995

[54] ROPE BRAKING DEVICE

[75] Inventor: William M. Scruggs, Joplin, Mo.

[73] Assignee: Engineered Resources, Inc., Joplin, Mo.

[21] Appl. No.: 323,738

[22] Filed: Oct. 17, 1994

[51] Int. Cl.[6] ..... B65H 59/14; B65H 59/16

[52] U.S. Cl. ..... 188/65.2; 182/42; 188/65.4; 254/389; 294/82.13; 248/340

[58] Field of Search ..... 294/82.13, 85; 24/115 H, 129, 300, 199; 188/65.1–65.5; 248/340, 303; 182/42, 191; 114/377; 482/120; 414/540, 543, 626; 254/389, 417, 199, 391, 262

[56] References Cited

U.S. PATENT DOCUMENTS

| | | | |
|---|---|---|---|
| 112,214 | 2/1871 | Brewer | 294/82.13 |
| 331,746 | 12/1885 | Watson | 188/65.4 |
| 944,644 | 12/1909 | Williams | 294/82.13 |
| 968,615 | 8/1910 | Welch | 188/65.4 |
| 1,104,521 | 7/1914 | Lowenstein | 188/65.1 |
| 1,230,169 | 6/1917 | Johnson | 188/65.4 |
| 1,376,414 | 5/1921 | Farnsworth | 294/82.13 |
| 1,439,245 | 12/1922 | Knapp | 414/626 |
| 2,354,107 | 7/1944 | Diamond | 294/82.13 |
| 2,377,845 | 6/1945 | Westfall | 414/626 |
| 2,515,918 | 7/1950 | Weeks et al. | 294/82.13 |
| 2,573,216 | 10/1951 | Natoli | 294/82.13 |
| 3,217,840 | 11/1965 | Holkesvick | 188/65.4 |
| 3,472,510 | 10/1969 | Holkesvick | 482/120 |
| 3,488,079 | 1/1970 | Stinchfield | 294/82.13 |
| 3,510,132 | 5/1970 | Holkesvick | 482/120 |
| 3,532,189 | 10/1970 | Wade | 188/65.3 |
| 3,606,323 | 9/1971 | Ottaviani | 482/120 |
| 3,650,531 | 3/1972 | Pridham | 482/120 |
| 3,656,745 | 4/1972 | Holkesvick | 482/120 |
| 3,958,825 | 5/1976 | Diamond | 294/82.13 |
| 4,343,466 | 8/1982 | Evans | 482/120 |
| 4,359,241 | 11/1982 | Kistner | 294/82.13 |
| 4,466,612 | 8/1984 | Marczewski | 482/120 |
| 4,598,795 | 7/1986 | Larson | 254/389 X |
| 4,832,391 | 5/1989 | Moell | 296/82.13 |
| 5,217,092 | 6/1993 | Potter | 188/65.1 |
| 5,348,439 | 9/1994 | Kuhn, Jr. | 414/543 |
| 5,352,172 | 10/1994 | Suzaki | 182/191 |

FOREIGN PATENT DOCUMENTS

| | | | |
|---|---|---|---|
| 1105779 | 12/1955 | France | 294/82.13 |
| 1201425 | 12/1959 | France | 294/82.13 |
| 152140 | of 1900 | United Kingdom | 294/82.13 |

*Primary Examiner*—Douglas C. Butler

*Attorney, Agent, or Firm*—Sughrue, Mion, Zinn, Macpeak & Seas

[57] ABSTRACT

A rope braking device is formed from a steel rod defining a substantially rectangular frame about which a rope may be entwined for the purpose of braking the passage of the rope through the rope braking device for the controlled lowering of an object secured to one end of the rope. The rod may be a single one-piece rod bent into the rectangular frame configuration with the opposite ends of the rod being bent into two upstanding hooks for supporting the rope braking device on a fixed support. When the rope braking device is used for lowering kegs from a truck, a keg hooking device is used which includes a pair of hook members, each having a hook engageable in a rim aperture of a keg and a loop secured to an oval ring adjacent the center of the keg wherein the loop and hook of each hook member are disposed orthagonally to each other.

2 Claims, 3 Drawing Sheets

ROPE BRAKING DEVICE

BACKGROUND OF THE INVENTION

The present invention is directed to a rope braking device and more specifically, to a rope braking device in combination with a keg gripping device for lowering kegs from a delivery truck.

Rope braking devices are old and well known in the art and generally consist of a device adapted to be suspended from a relatively high point. A rope is threaded through the rope braking device with one end thereof attached to a heavy object which is to be lowered from a high elevation to a low elevation. The opposite end of the rope is held by a person who may be located at either elevation and who will pay out the rope through the rope braking device to lower the object in a controlled manner.

In such rope braking devices, the rope generally follows a torturous path about a number of fixed rods so as to provide substantial friction as the rope passes through the device. A number of devices of this type are disclosed in the U.S. Pat. No. to Wade (U.S. Pat. No. 3,543,189). The U.S. Pat. No. to Nutkins (U.S. Pat. No. 5,295,559) also discloses a reversable friction brake device for use with a rope or the like wherein the frictional relationship between the rope and a plurality of rollers, end links, snap links and an axle, brake the travel of the rope through the brake device thereby allowing a single rope handler to lower heavy weights attached to the rope in a controlled fashion.

A number of other rope braking devices include a plurality of pulleys which are rotatably mounted in a frame about which a rope is entrained. The application of a force to the rope causes pivoting of the frame to bring the rope into contact with a braking surface to thereby retard passage of the rope around the pulleys. Rope braking devices of this type are disclosed in the U.S. Patents to Hembacher (U.S. Pat. No. 542,641) Bergquist (U.S. Pat. No. 854,922) and Johansson (U.S. Pat. No. 1,116,434).

All of the forementioned rope braking devices are comprised of a plurality of individual parts which require an extensive assembly operation. Such an operation can be time consuming and expensive. Furthermore, most assemblies having moving parts are more prone to malfunctions which could create a serious safety problem.

SUMMARY OF THE INVENTION

The present invention provides a new and improved rope braking device which overcomes the drawbacks enumerated above with respect to the previously patented devices.

The present invention provides a new and improved rope braking device which is compact and simple to fabricate and does not involve any moving parts whatsoever.

The present invention provides a new and improved rope braking device comprised of rod means forming a substantially rectangular frame having sides, a bottom and a top and hook means connected to said frame for supporting said device wherein a rope is adapted to be entwined about said sides, bottom and top of said frame to provide frictional braking of the rope through said frame for lowering an object secured to one end of the rope.

The present invention provides a new and improved keg hooking device which may be used with the rope braking device according to the present invention wherein the keg hooking device is comprised of a pair of hook members engageable in opposed rim apertures of a keg, said hook members being movably connected to an oval-shaped ring which in turn is connected to a rope passing through said frame of said rope braking device to control lowering of the keg wherein each of said hook members is provided with a hook at one end and a bent loop at an opposite end for engagement with said ring with said hook and said loop being located in orthagonally disposed planes.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
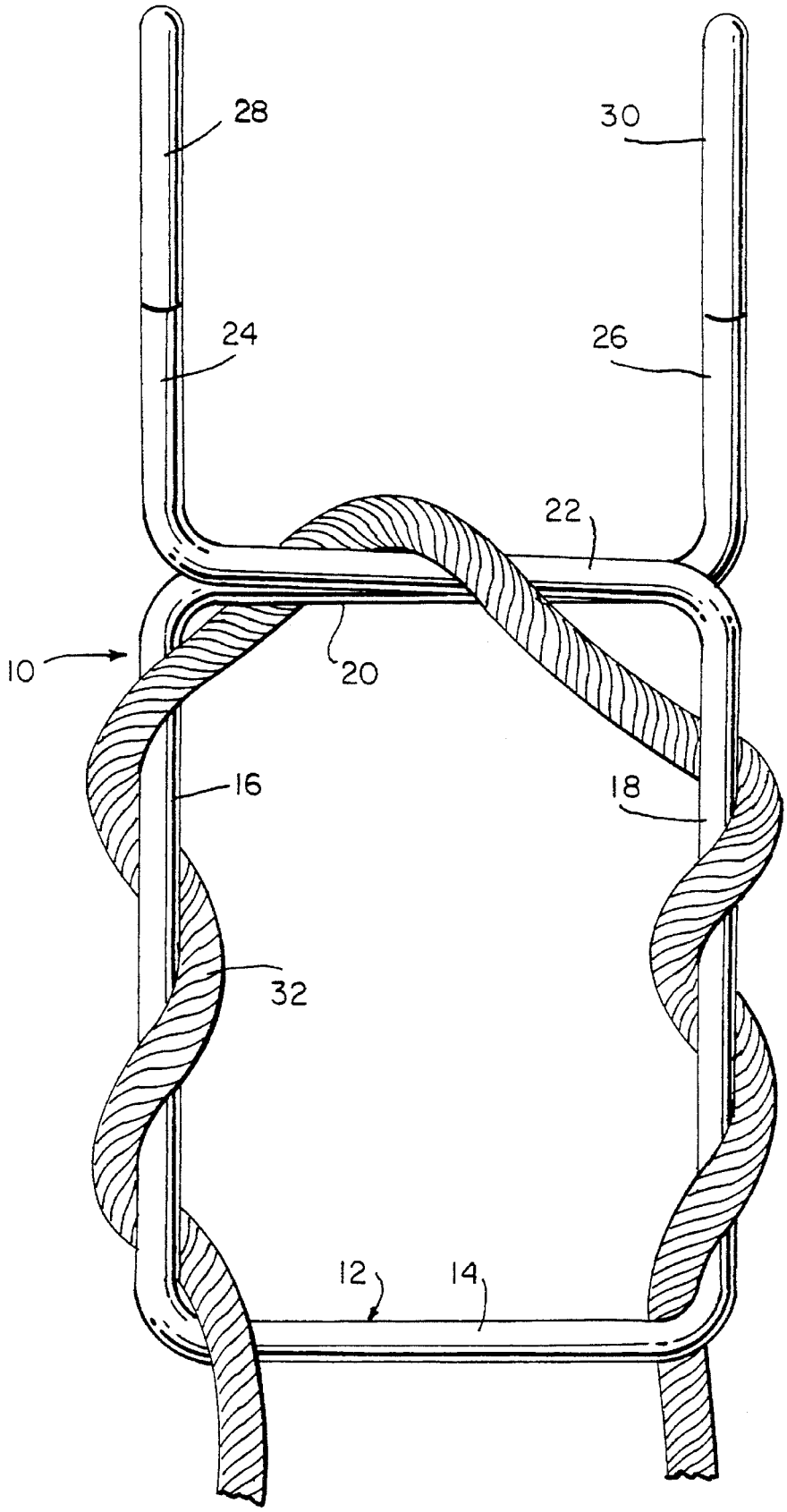
FIG. 1 is a front elevational view of a rope braking device according to the present invention.

The rope braking device 10 shown in FIG. 1 is constructed from a single piece of steel rod which has been bent into the configuration shown and which does not require any additional assembly other than the bending operation. The steel rod 12 is bent into a substantially rectangular frame comprised of a bottom section 14, substantially parallel side sections 16 and 18 and a pair of substantially parallel contiguous top sections 20 and 22. The steel rod is then bent upwardly at opposite sides of the rectangular frame to provide upstanding legs 24 and 26, which are disposed in substantially the same plane as the rectangular frame. The free ends of the rod are then bent to provide hook portions 28 and 30 which are adapted to engage any suitable support (not shown). A rope 32 is entwined about the bottom, side and top sections of the rectangular frame so as to provide frictional braking for the rope as it passes through the rope braking device. One end of the rope 32 may be connected to an object or load to be lowered while the opposite end is maintained under the control of a person or a suitable mechanical device (not shown) such as a winch. The frictional braking force produced by the rope in engagement with the rod may be varied by increasing or decreasing the number of turns of the rope about the various sections of the frame. The diameter of the steel rod may be varied depending upon the weight of the load to be lowered. For example, it has been found that a ¼ inch diameter steel rod is sufficient for lowering beer kegs from a truck to the ground. The provision of the two contiguous sections 20 and 22 forming the top of the frame provides added strength to the frame where it is most needed. Likewise, the provision of two hooks distributes the weight of the load along the member upon which the rope braking device is mounted.

Figure 2:
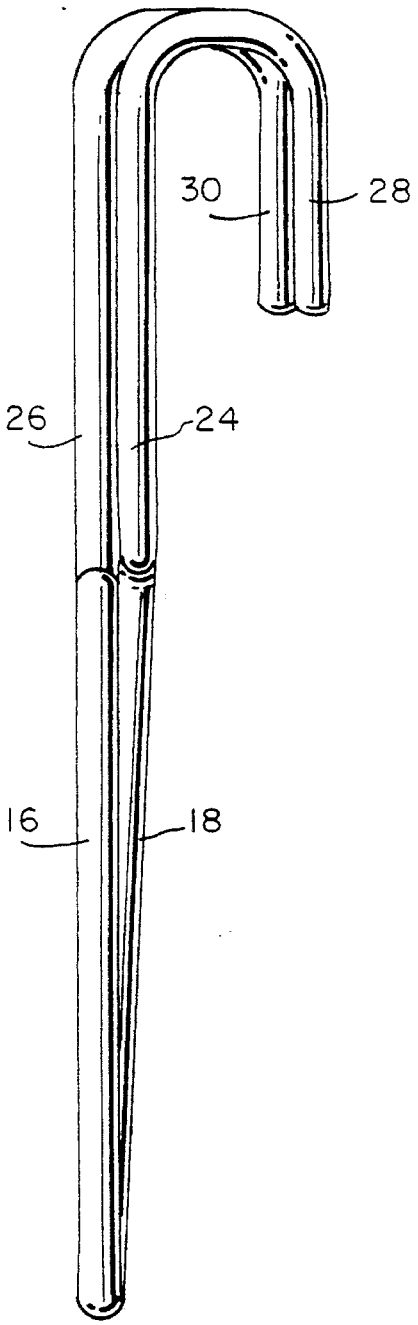
FIG. 2 is a side elevational view of the rope braking device shown in FIG. 1 without the rope.

In the assembly of the rope braking device, it is only necessary to provide suitable bending means for bending the steel rod into the configuration shown in FIGS. 1 and 2. No other assembly steps are required since it is not necessary to weld the rod sections 20 and 22 together or connect them by any other means. Thus, the rope braking device can be quickly and economically produced to provide a strong efficient rope braking operation.

Figure 3:
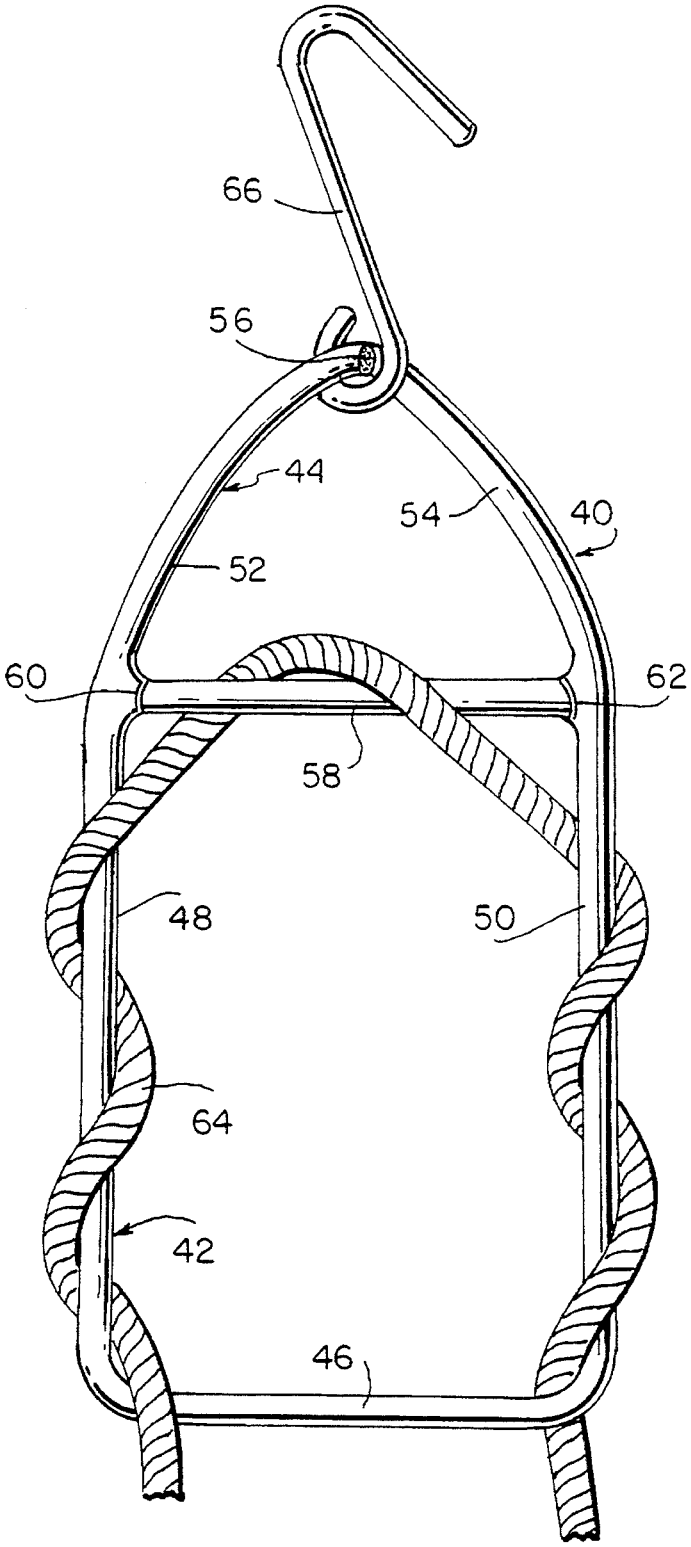
FIG. 3 is a front elevational view of a modified form of the rope braking device according to the present invention.

A modified form of rope braking device is shown in FIG. 3 wherein the frame 40 is constructed from steel rods which are welded together to provide a rectangular frame 42 and a supporting loop 44. By way of example, the rope braking device could be fabricated from a first rod which defines the bottom 46 and opposite sides 48 and 50 of the rectangular frame and the opposite sides 52 and 54 of the loop with the opposite ends of the rod being welded together at 56. A second steel rod forms the top 58 of the rectangular frame and is welded at opposite ends to the first rod at 60 and 62. Other arrangements for forming the rope braking device may be utilized.

A rope 64 is entwined about the bottom sides and top of the rectangular frame in a manner substantially identical to that shown in FIG. 1. An S-shaped hook 66 is engaged with the loop at one end with the opposite end being adapted to be hooked over any convenient support member.

Figure 4:
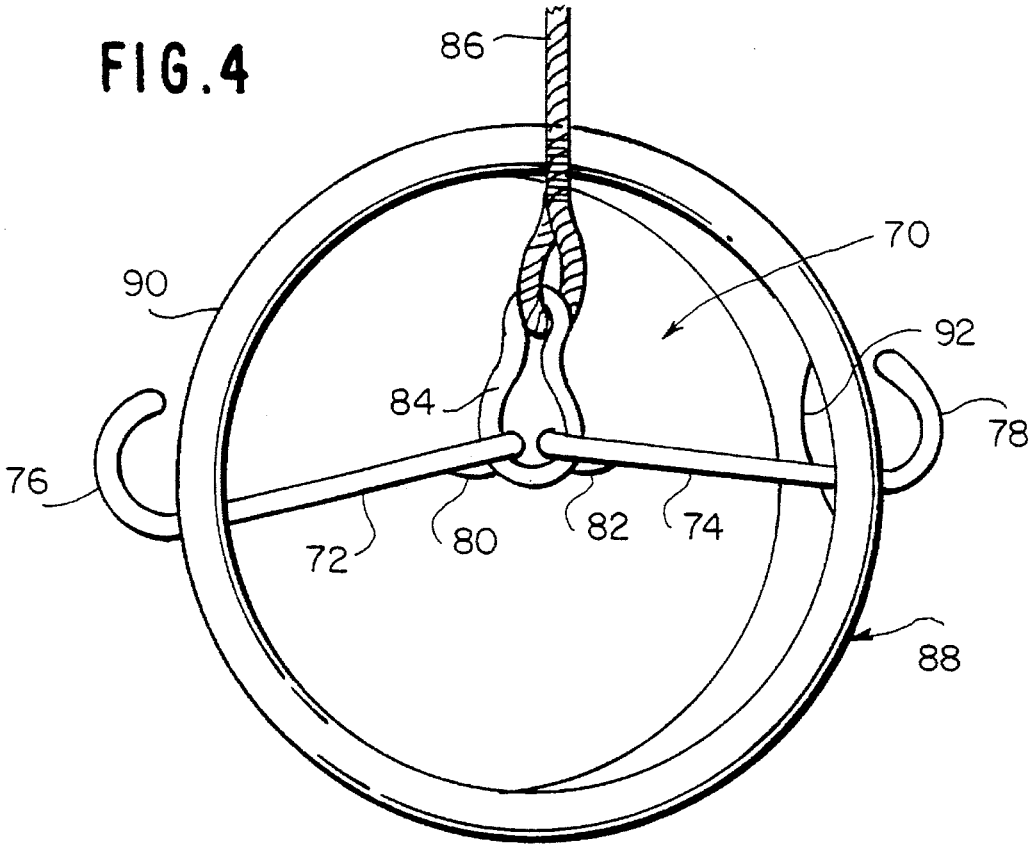
FIG. 4 is a top plan view of a keg hooking device in an initial position.
Figure 5:
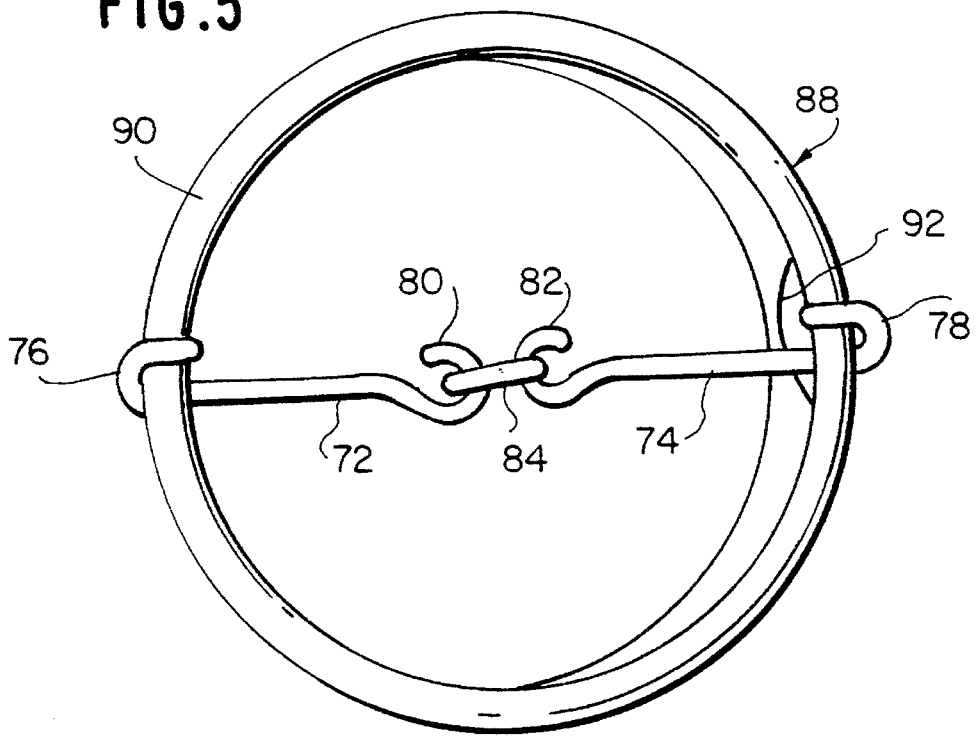
FIG. 5 is a top plan view similar to FIG. 4 with the keg hooking device fully engaged with the keg.

The keg hooking device 70 shown in FIGS. 4 and 5, is comprised of a pair of hook members 72 and 74 which are provided with hooks 76 and 78 at one end thereof and a pair of loops 80 and 82 at the opposite ends thereof respectively. The loops 80 and 82 are disposed in a plane orthagonal to the plane in which the hooks 76 and 78 are disposed. The loops 80 and 82 are secured in an oval-shaped ring 84 adjacent one end of the ring while a rope 86 may be secured to the opposite end of the ring. Conventional kegs 88 are provided with upstanding edges 90 having a pair of opposed apertures 92 (only one of which is shown) formed therein for the purpose of lifting and lowering the keg.

The keg hooking device shown in FIGS. 4 and 5 is particularly useful for removing and lowering the top keg from a truck wherein the kegs have been stacked three high in a truck bay. In this situation, there is very little clearance between the top keg and the roof of the truck bay. The hook members 72 and 74 can be inserted in the handle apertures 92 of the top keg as shown in FIG. 4 with the ring 84 and the rope 86 extending substantially horizontally outwardly to a rope braking device such as those shown in FIGS. 1–3 which is hanging from the top rim of the door of the truck bay. BY having the loops 80 and 82 of the hook members disposed orthagonally to the hooks 76 and 78, respectively, the ring 84 can more readily be disposed in the horizontal position and the hooks 76 and 78 can readily extend through the handle apertures 92. Since the point of attachment is placed more nearly in the center of the keg, the amount of drop and swing of the keg is reduced when it is pulled off the lower keg to be lowered to the ground. As the keg is being pulled out of the bay and lowered to the ground, the hook members 72 and 74 and the ring 843 will assume the positions shown in FIG. 5.

While the invention has been particularly shown and described with reference to preferred embodiments thereof, it will be understood by those in the art that the foregoing and other changes in form and details may be made therein without departing from the spirit and scope of the invention.

What is claimed is:

1. A rope braking device for lowering an object from a higher elevation to a lower elevation comprises rod means forming a substantially rectangular frame having sides, a bottom and a top and hook means connected to said frame for supporting said device from a fixed support, wherein a rope is adapted to be entwined about said sides, bottom and top of said frame to provide frictional braking of the rope through said frame for lowering an object secured to one end of the rope, wherein said rod means and said hook means are comprised of a single, one-piece rod having an intermediate portion bent to form said frame with said top being comprised of two substantially parallel, contiguous rod portions and having opposite end portions forming a pair of hooks for supporting said device.

2. A rope braking device as set forth in claim 1, in combination with a keg hooking device comprising a pair of hook members engageable in opposed rim apertures of a keg, said hook members being movably connected to an oval-shaped ring and a rope connected to one end of the ring and passing through said frame of said rope braking device to control lowering of the keg wherein each of said hook members is provided with a hook at one end and a bent loop at an opposite end engaged with said ring with said hook and loop being located in orthogonally disposed planes, respectively.

* * * * *